US006314256B1

(12) United States Patent
Saitoh

(10) Patent No.: US 6,314,256 B1
(45) Date of Patent: Nov. 6, 2001

(54) IMAGE FORMING APPARATUS WITH FIXING UNIT FALLING OFF PREVENTING DEVICE

(75) Inventor: Hiroshi Saitoh, Ayase (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/624,389

(22) Filed: Jul. 27, 2000

(30) Foreign Application Priority Data

Jul. 27, 1999 (JP) ..... 11-212416

(51) Int. Cl.[7] ..... G03G 15/20
(52) U.S. Cl. ..... 399/122
(58) Field of Search ..... 399/122, 320, 399/328; 219/216

(56) References Cited

U.S. PATENT DOCUMENTS 5,579,098 * 11/1996 Noguchi et al. ..... 399/122
5,742,878 * 4/1998 Kuroda ..... 399/122
5,956,547 * 9/1999 Kamei et al. ..... 399/122

* cited by examiner

*Primary Examiner*—William J. Royer

(74) *Attorney, Agent, or Firm*—Oblon, Spivak, McClelland, Maier & Neustadt, P.C.

(57) ABSTRACT

An image forming apparatus including a fixing unit, detachably provided in the image forming apparatus, to fix a toner image transferred on a sheet onto the sheet, and a fixing unit falling off preventing device to prevent the fixing unit from falling off of the image forming apparatus. The fixing, unit falling off preventing device includes a first fixing unit supporting member and a second fixing unit supporting member which each support the fixing unit at a predetermined position within the image formate apparatus. The first fixing unit supporting member releases support of the fixing unit upon being depress ed, and the second fixing unit supporting member releases support of the fixing unit upon being rotated in a predetermined direction. In a second embodiment, the image forming, apparatus includes a case having a knob at a part thereof so that the second fixing unit supporting member, of the fixing unit falling off preventing device, has a knob part which opposes the knob of the case of the fixing unit in a vicinity thereof, and which releases the support of the fixing unit by being moved in a predetermnined direction while being held at the knob part thereof. In a third embodiment, the second fixing unit supporting member, of the fixing, unit falling off preventing device, is configured to restrict and release a movement of the first fixing, unit supporting member in a direction to release the support of the fixing unit.

29 Claims, 6 Drawing Sheets

IMAGE FORMING APPARATUS WITH FIXING UNIT FALLING OFF PREVENTING DEVICE

CROSS-REFERENCE TO RELATED APPLICATIONS

This application claims priority under 35 U.S.C. §119 to Japanese patent application no. 11-212416, filed on Jul. 27, 1999, which application is herein incorporated by reference.

BACKGROUND OF THE INVENTION

Field of the Invention

The present invention generally relates to image forming apparatus, such as copying machines, facsimile machines, printers and copying/facsimile/printing machines, and more particularly, to a device for preventing a fixing unit, provided within the image forming apparatus to fix a toner image transferred on a sheet onto the sheet, from inadvertently falling off of the apparatus.

Discussion of the Background

FIG. 1 is a schematic drawing illustrating a construction of a conventional printer for explaining a method of removing a fixing unit from a main body of the printer. Reference numeral 1 denotes the main body of the printer, reference numeral 2 denotes a sheet cassette, and reference numeral 3 denotes an electrophotographic image forming unit, which includes a photoconductor 4. Reference numeral 5 denotes the fixing unit, which includes a heating roller 6 and a pressing roller 7. The fixing unit 5 fixes a toner image, which has been transferred by the electrophotographic image forming unit 3 onto a recording sheet P by applying heat and pressure. Reference numeral 8 denotes a conveying path for the recording sheet P and reference numeral 9 denotes a discharging roller for discharging the recording sheet P after a fixing operation has been accomplished thereon to a discharged sheet tray 10. Reference numeral 111 denotes an openable and closable cover that opens and closes to uncover and cover, respectively, a front side of the conveying path 8 and the fixing unit 5 (the right side in FIG. 1).

The fixing unit 5 is detachably provided inside of the main body 1 of the printer so that the fixing unit 5 can be detached from the main body 1, for example, for replacement with a new one. At an upper front part of the fixing unit 5, a fixing unit supporting lever 12 and a pressure releasing lever 13 are provided side by side. The fixing unit supporting lever 12 is depressed to release a support of the fixing unit 5 in the main body 1 when removing the fixing unit 5 from the main body 1 for replacement, for example, and the pressure releasing lever 13 is depressed to release an applying pressure of the pressing roller 7 when removing a recording sheet P which has become jammed at a nip between the heating roller 6 and the pressing roller 7.

The cover 11 is supported by an axis 14 at a bottom part of the cover 11 so as to be rotatable relative to the main body 1. The cover 11 is opened to uncover the inside of the main body 1 when replacing the fixing unit 5 or when removing a recording sheet P which has become jammed at the conveying path 8 or in the fixing unit 5. Under normal conditions, the cover 11 is closed to cover the fixing unit supporting lever 12 and the pressure releasing lever 13, and the front side of the conveying path 8 and the fixing unit 5 as well.

When replacing the fixing unit 5, the user first opens the cover 11 to uncover the front side of the main body 1, depresses the fixing unit supporting lever 12, and then draws out the fixing unit 5. When removing a recording sheet P which has become jammed at the nip between the heating roller 6 and the pressing roller 7 of the fixing unit 5, the user likewise opens the cover 11 to uncover the front side of the main body 1, and then depresses the pressure releasing lever 13 to release the pressure of the pressing roller 7 for facilitating the clearance of the jammed recording sheet P.

However, in the above-described conventional printer, the fixing unit supporting lever 12, which is used when replacing the fixing unit 5, and the pressure releasing lever 13, which is used when removing a jammed recording sheet P at the nip between the heating roller 6 and the pressing roller 7, are arranged in close proximity to each other. Further, both the fixing unit supporting lever 12 and the pressure releasing lever 13 are operated by depressing operations which closely resemble each other. Therefore, the user tends to erroneously operate the fixing unit supporting lever 12, not the pressure releasing lever 13, for removing a jammed recording sheet P. Further, the user often inadvertently touches the fixing unit supporting lever 12 while operating the pressure releasing lever 13.

SUMMARY OF THE INVENTION

The present invention has been made in view of and addresses the above-discussed and other problems.

Preferred embodiments of the present invention provide a novel image forming apparatus in which a fixing unit is prevented from falling off of the apparatus by an erroneous or inadvertent operation by the user and thereby the safeness of the apparatus is enhanced.

A preferred embodiment of the present invention provides an image forming apparatus including a fixing unit, that is detachably provided in the apparatus to fix a toner image transferred on a sheet onto the sheet, and a fixing unit falling off preventing device, to prevent the fixing unit from falling off the apparatus. The fixing unit falling off preventing device includes a first fixing unit supporting member and a second fixing unit supporting member that both support the fixing unit at a predetermined position within the apparatus. The first fixing unit supporting member releases the support of the fixing unit upon being depressed, and the second fixing unit supporting member releases the support of the fixing unit upon being rotated in a predetermined direction.

The image forming apparatus may further include a cover that opens and closes relative to the apparatus to uncover and cover, respectively, the fixing unit, and the second fixing unit supporting member may include a closure obstructing part that abuts against the cover, when the second fixing unit supporting member is not supporting the fixing unit, so as to prevent the cover from moving to a position to be closed.

According to the present invention, the fixing unit falling off preventing device may further include a return device for returning the second fixing unit supporting member to a position to support the fixing unit after releasing the support of the fixing unit.

Another preferred embodiment of the present invention provides an image forming apparatus including a fixing unit, that is detachably provided in the apparatus to fix a toner image transferred on a sheet onto the sheet, and that includes a case having a knob at a part thereof, and a fixing unit falling off preventing device, to prevent the fixing unit from falling off the apparatus. The fixing unit falling off preventing device includes a first fixing unit supporting member and a second fixing unit supporting member that both support the fixing unit at a predetermined position within the apparatus. The first fixing unit supporting member releases the support of the fixing unit upon being depressed. The second fixing unit supporting member has a knob part, which opposes the knob of the case of the fixing unit in a vicinity thereof, and which releases the support of the fixing unit by being moved in a predetermined direction while being held at the knob part thereof.

The fixing unit falling off preventing device may further include a return device for returning the third fixing unit supporting device to a position to support the fixing unit after releasing the support of the fixing unit.

Another preferred embodiment of the present invention provides an image forming apparatus including a fixing unit, that is detachably provided in the apparatus to fix a toner image transferred on a sheet onto the sheet, and a fixing unit falling off preventing device to prevent the fixing unit from falling off of the apparatus. The fixing unit falling off preventing device includes a first fixing unit supporting member, that supports the fixing unit at a predetermined position within the apparatus and that releases a support of the fixing unit by being depressed, and a second fixing unit supporting member, that is configured to restrict and release a movement of the first fixing unit supporting member in a direction to release the support of the fixing unit.

BRIEF DESCRIPTION OF THE DRAWINGS

A more complete appreciation of the present invention and many of the attendant advantages thereof will be readily obtained as the same becomes better understood by reference to the following detailed description when considered in conjunction with accompanying drawings, wherein.

DETAILED DESCRIPTION OF THE PREFERRED EMBODIMENTS

Figure 1:
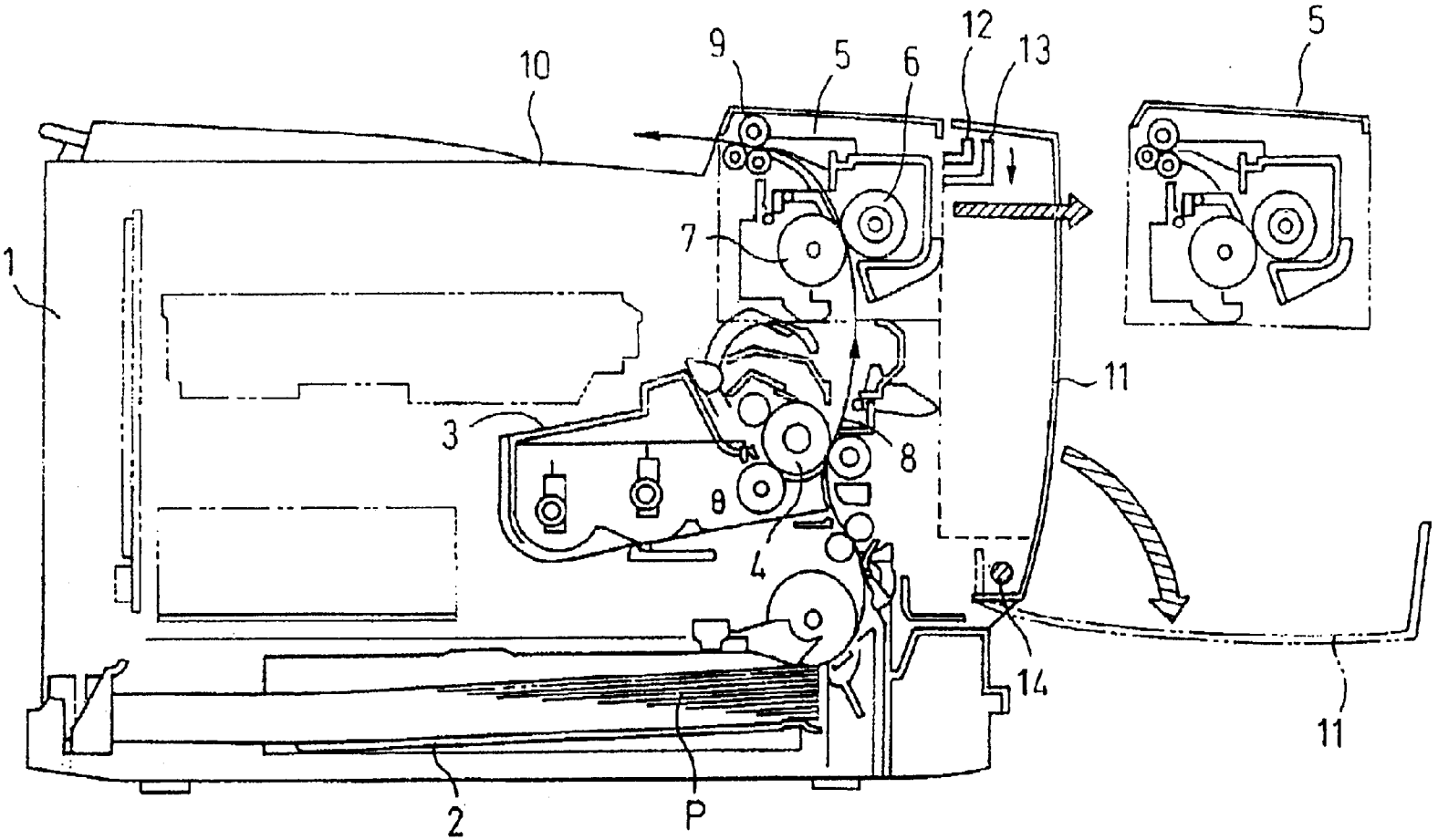
FIG. 1 (PRIOR ART)
FIG. 1 is a schematic drawing illustrating a construction of a conventional printer for explaining a method of removing a fixing unit from a main body of the printer.

Referring now to the drawings, wherein like reference numerals designate identical or corresponding parts throughout the several views, preferred embodiments of the present invention are described.

Figure 2:
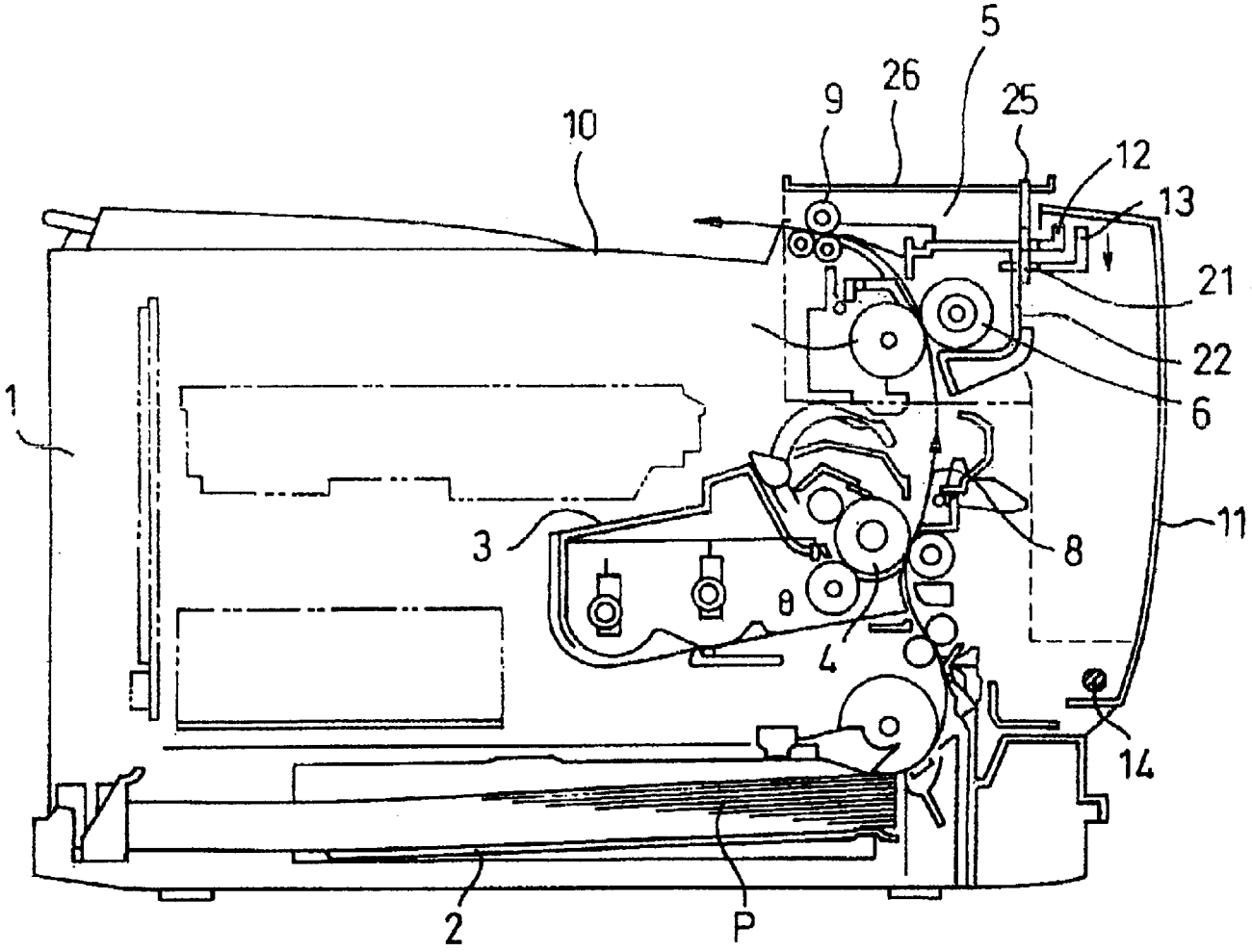
FIG. 2 is a schematic drawing illustrating a construction of a printer according to a preferred embodiment of the present invention.

FIG. 2 is a schematic drawing illustrating a construction of a printer according to a preferred embodiment of the present invention. The construction of the printer is substantially the same as the one illustrated in FIG. 1, except that the fixing unit supporting lever 12 (i.e., a first fixing unit supporting member that is depressed to release the support of the fixing unit 5 relative to the main body 1 when removing the fixing unit 5 from the main body 1) has a fixing unit supporting knob 21 provided there beside. The fixing unit supporting knob 21 acts as a second fixing unit supporting member that supports the fixing unit 5 relative to the main body 1 and is provided at a case 22 of the fixing unit 5.

Figure 3:
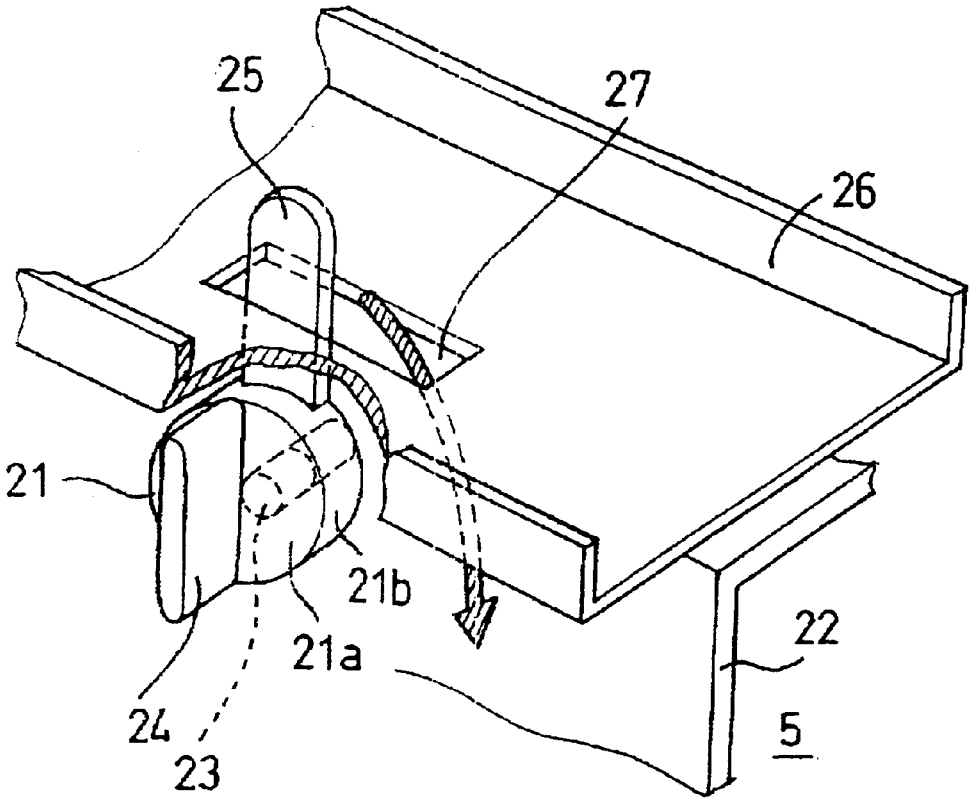
FIG. 3 is a perspective view of a front part of a part of the printer relating to a fixing unit supporting and releasing mechanism, illustrating a state wherein the fixing unit is supported by a main body of the printer.
Figure 4:
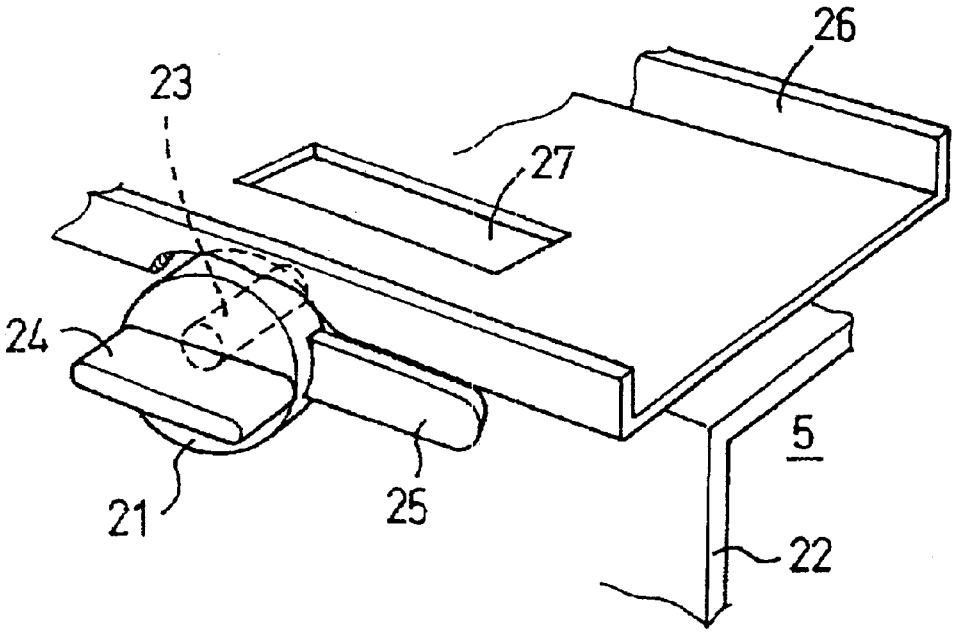
FIG. 4 is another perspective view of the front part of the printer, illustrating a state wherein the support of the fixing unit is released.

FIG. 3 is a perspective view of a front part of a part of the printer relating to a fixing unit supporting and releasing mechanism, illustrating a state wherein the fixing unit 5 is supported by the main body 1 of the printer, and FIG. 4 is another perspective view of the front part of the printer, illustrating a state wherein the support of the fixing unit 5 is released.

As illustrated in FIG. 3, the fixing unit supporting knob 21 is provided so as to be rotatable relative to the case 22 which is centered on a central axis 23. Further, a knob part 24 is formed at a front surface 21*a* and a stopping lever 25 is provided in a protruding manner at a part of a circumferential wall 21*b* of the fixing unit supporting knob 21. The stopping lever 25 engages with and disengages from an engaging hole 27 in a fixing plate member 26 of the main body 1 and provided above the fixing unit 5.

In the printer described above, when removing the fixing unit 5 from the printer, the user first depresses the fixing unit supporting lever 12 to release the support of the fixing unit 5 from the main body 1 with the fixing unit supporting lever 12 to partly put the fixing unit 5 in a removable condition. While the user thus depresses the fixing unit supporting lever 12, as illustrated in FIGS. 3 and 4, the user rotates the stopping lever 25 about 90 degrees in a clockwise direction by holding the knob part 24 of the fixing unit supporting knob 21 so as to release the engagement of the stopping lever 25 and the engaging hole 27 of the fixing plate member 26.

According to the above-described preferred embodiment, the support of the fixing unit 5 in the main body 1 can be released to put the fixing unit 5 in a condition for removal from the printer by performing different kind of operations of different members in different positions, i.e., the depressing operation of the fixing unit supporting lever 12 and the rotating operation of the fixing unit supporting knob 21. Therefore, the risk the fixing unit 5 falling off of the apparatus by inadvertently depressing the fixing unit supporting lever 12 and putting the fixing unit 5 in a removable condition, as in the conventional apparatus, is avoided.

Figure 5:
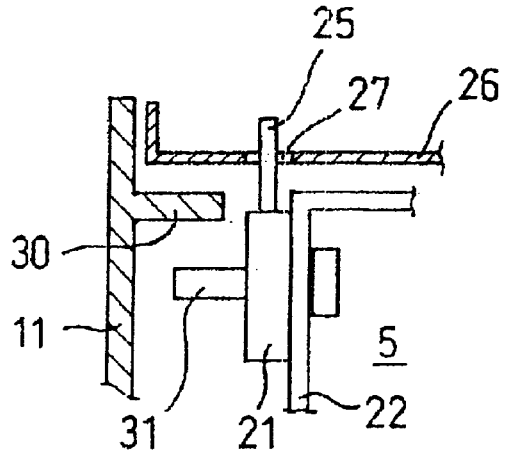
FIG. 5 is a cross-sectional view of a front part of a part of the printer relating to a fixing unit supporting and releasing mechanism, according to another preferred embodiment of the present invention, illustrating a state wherein the fixing unit is supported.
Figure 6:
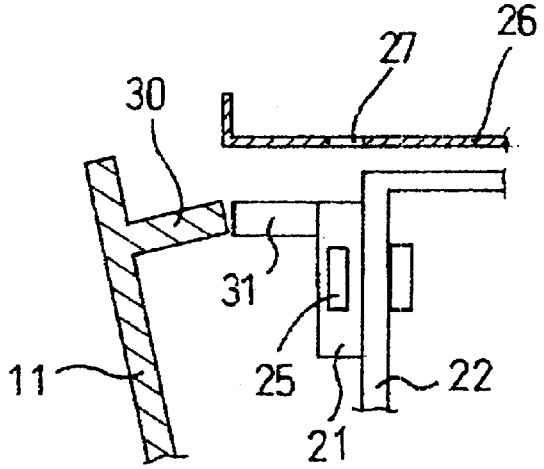
FIG. 6 is another cross-sectional view of the front part of the printer, illustrating a state wherein the support of the fixing unit is released.
Figure 7:
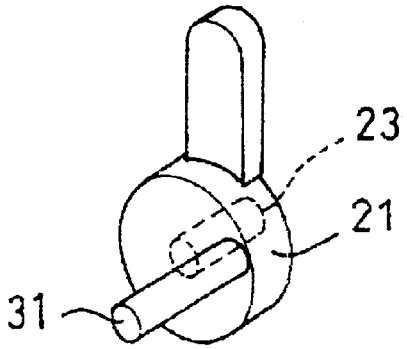
FIG. 7 is a perspective view illustrating a fixing unit supporting knob having a protruding pin that deviates from the central axis thereof.

FIGS. 5 and 6 are cross sections illustrating a front part of a part of the printer relating to a supporting and releasing mechanism of the fixing unit 5 relative to the main body 1 of the printer, according to another preferred embodiment of the present invention. FIG. 5 illustrates a state wherein the fixing unit 5 is supported on the main body 1, and FIG. 6 illustrates a state that the support of the fixing unit 5 is released. The construction of the printer is substantially the same as the one of the previous embodiment, except that a protruding rib 30 is provided at an internal surface of the cover 11 and a protruding pin 31 is extended from the fixing unit supporting knob 21. As illustrated in FIG. 7, the protruding pin 31 is positioned so as to deviate from the central axis 23.

As illustrated in FIG. 5, when the stopping lever 25 is in a position to engage with the engaging hole 27 of the fixing plate member 26 so as to support the fixing unit 5, the protruding pin 31 does not abut against the protruding rib 30 of the cover 11. Therefore, the cover 11 can be closed to cover the front side of the main body 1.

On the other hand, as illustrated in FIG. 6, when the cover 11 uncovers the front side of the main body 1 and the stopping lever 25 of the fixing unit supporting knob 21 is disengaged from the engaging hole 27 of the fixing plate member 26 so that the support of the fixing unit 5 is released, the protruding pin 31 abuts against the protruding rib 30 of the cover 11, such that the cover 11 cannot be returned to a closed position.

As described above, according to the above preferred embodiment, the cover 11 cannot be returned to the closed position unless the stopping lever 25 of the fixing unit supporting knob 21 is returned to the position to engage with the engaging hole 27. Therefore, in addition to the effect obtained according to the first preferred embodiment, another effect is obtained wherein the user is notified of an oversight of not returning the fixing unit supporting knob 21 by the unclosed condition of the cover 11.

In the first embodiment, such an oversight of not returning the fixing unit supporting knob 21 can be also prevented by providing a return device, such as a return spring, to press the stopping lever 25 to a position to engage with an engaging hole 27 of the fixing unit supporting knob 21.

Figure 8:
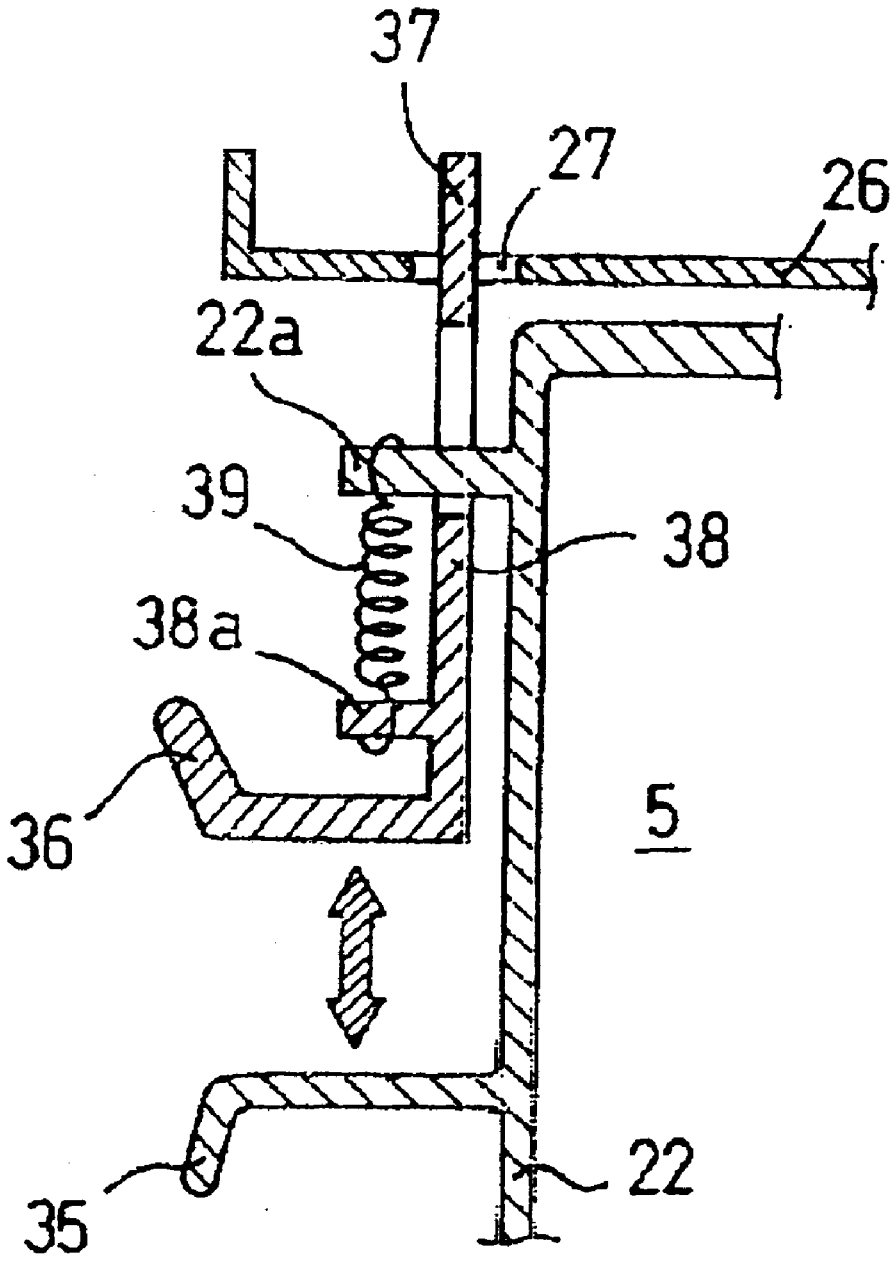
FIG. 8 is a cross-sectional view of a front part of a part of the printer relating to a supporting and releasing mechanism of the fixing unit, according to another preferred embodiment of the present invention.

FIG. 8 is a cross section illustrating a front part of a part of the printer relating to a supporting and releasing mechanism of the fixing unit 5 relative to the main body 1 of the printer, according to another preferred embodiment of the present invention. FIG. 8 illustrates a state wherein the fixing unit 5 is supported by the main body 1.

As illustrated in FIG. 8, an L-shaped fixing unit supporting lever 38 (i.e., a fixing unit supporting member) includes a knob part 36 opposing a knob 35 provided at a front surface of the case 22 of the fixing unit 5, and a stopping lever part 37 that engages with the engaging hole 27 of the fixing plate member 26. A spring 39 is arranged between a part 38*a* of the L-shaped fixing unit supporting lever 38 and a part 22*a* of the case 22 of the fixing unit 5 so as to press the stopping lever part 37 in a direction to engage with the engaging hole 27.

In this embodiment, after the fixing unit 5 is put in a predetermined position after replacement, for example, when the user releases the knob part 36, the stopping lever part 37 of the L-shaped fixing unit supporting lever 38 is automatically moved in the direction to engage with the engaging hole 27 (upward in FIG. 8) due to the pressing force of the spring 39. Therefore, the above-described over sight problem of not returning the L-shaped fixing unit supporting lever 38 is avoided.

Further, when releasing the engagement of the stopping lever part 37 and the engaging hole 27, the user depresses the L-shaped fixing unit supporting lever 38, while resisting the pressing force of the spring 39 by holding the knob 35 of the case 22 and the knob part 36 of the L-shaped fixing unit supporting lever 38. Therefore, when the user replaces the fixing unit 5 with a new one, the risk of touching a surrounding part of the fixing unit 5, which is heated, is avoided.

Figure 9:
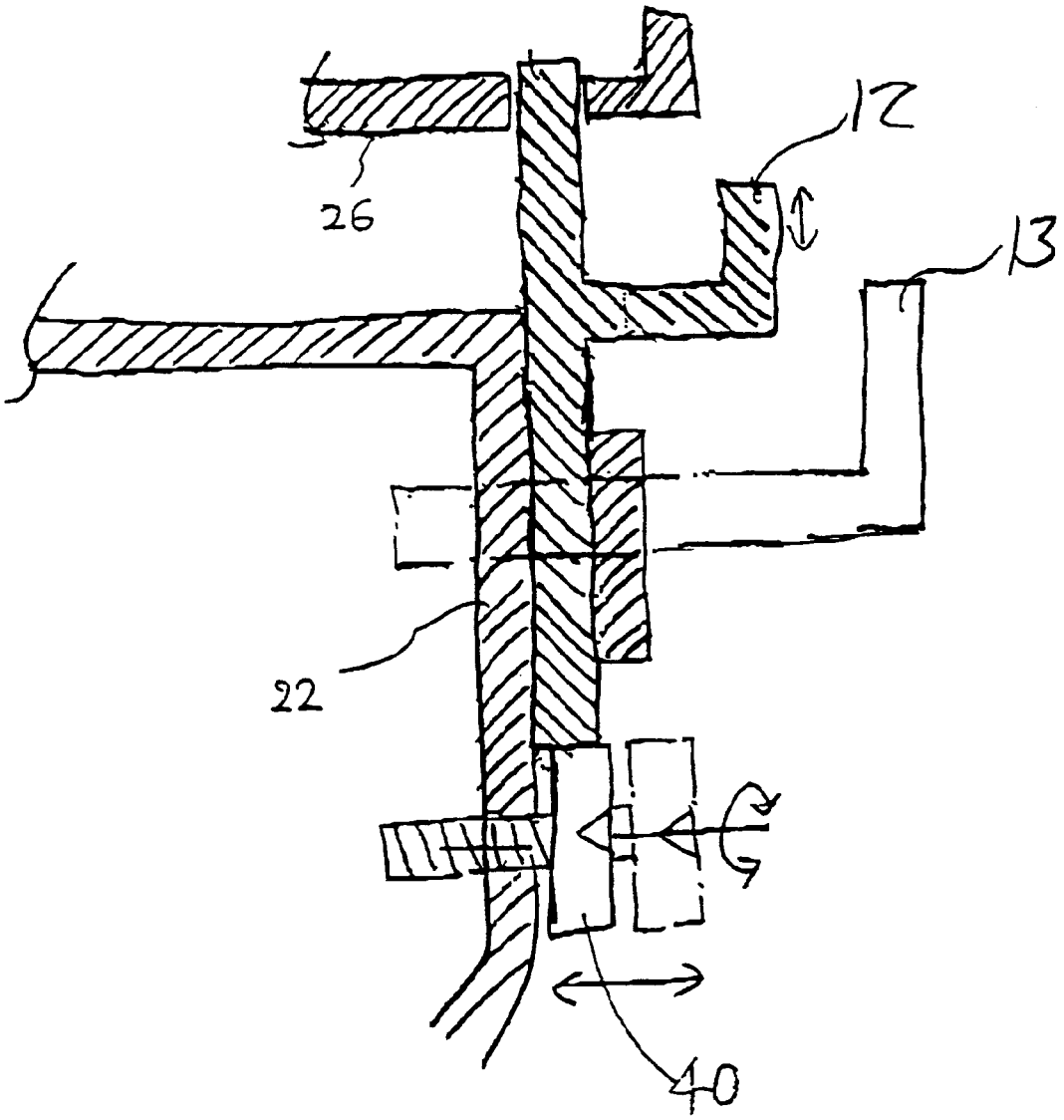
FIG. 9 is a cross-sectional view of a front part of a part of the printer relating to a fixing unit supporting and releasing mechanism, according to still another preferred embodiment of the present invention.

FIG. 9 is a cross section illustrating a front part of a part of the printer, relating to a supporting and releasing mechanism of the fixing, unit 5 relative to the main body 1 of the printer, according to still another preferred embodiment of the present invention. FIG. 9 illustrates a state that the fixing, unit 5 is supported by the main body 1. In this embodiment, as illustrated in FIG. 9, a second fixing unit supporting member 40 is provided on the case 22 so as to support the first fixing unit supporting member 12 in the position to support the fixing unit 5. That is, unless the second fixing unit supporting member 40 is removed from the case 22, the first fixing unit supporting member 12 can not be depressed. Thus, the fixing unit 5 is prevented from falling, off of the main body 1 as a result of the first fixing unit supporting member 12 having been erroneously depressed or touched. The second fixing unit supporting member 40 may be configured by any type of supporting members that can be fixed to and removed from the case 22, for example, a screw, a cam, a pin, etc. When removing, the fixing unit 5 for replacement, for example, the user must first remove the second fixing unit supporting member 40 from the case 22, and then depresses the first fixing unit supporting member 12. Thus, unless the user or the service person removes the second fixing unit supporting member 40, even if the user erroneously depresses or touches the first fixing unit supporting member 12, the fixing unit 5 will not be removed from the main body 1.

Numerous additional modifications and variations of the present invention are possible in light of the above teachings. It is therefore to be understood that within the scope of the appended claims, the present invention may be practiced otherwise than as specifically described herein.

The present application claims priority and contains subject matter related to Japanese Patent Application No. 11-212416 filed in the Japanese Patent Office on Jul. 27, 1999, and the entire contents of which are hereby incorporated by reference.

What is claimed as new and desired to be secured by Letters Patent of the United States is:

1. An image forming apparatus, comprising:

a fixing unit, detachably provided in said image forming apparatus, to fix a toner image, which has been transferred on a sheet onto the sheet; and a fixing unit falling off preventing device to prevent said fixing unit from falling off of said image forming apparatus, said fixing unit falling off preventing device including a first fixing unit supporting member and a second fixing unit supporting member which each support said fixing unit at a predetermined position within said image forming apparatus, said first fixing unit supporting member releasing support of said fixing unit upon being depressed, and said second fixing unit supporting member releasing support of said fixing unit by being rotated in a predetermined direction.

2. The image forming apparatus according to claim 1, further comprising:

a cover that opens and closes relative to said image forming apparatus to uncover and cover, respectively, said fixing unit; and said second fixing unit supporting member including a closure obstructing part that abuts against said cover, when said second fixing unit supporting member is not supporting said fixing unit, so as to obstruct said cover from moving to a position to be closed.

3. The image forming apparatus according to claim 1, wherein said fixing unit falling off preventing device further comprises a return device to return said second fixing unit supporting member to a position to support said fixing unit after releasing support of said fixing unit.

4. An image forming apparatus, comprising:

a fixing unit, detachably provided in said image forming apparatus, to fix a toner image transferred on a sheet onto the sheet, said fixing unit including a case having a knob at a part thereof, and a fixing unit falling off preventing device to prevent said fixing unit from falling off said image forming apparatus, said fixing unit falling off preventing device including a first fixing unit supporting member and a second fixing unit supporting member which each support said fixing unit at a predetermined position within said image forming apparatus, said first fixing unit supporting member releasing support of said fixing unit upon being depressed, and said second fixing unit supporting member having a knob part, opposing said knob of said case of said fixing unit in a vicinity of said fixing unit, and releasing support of said fixing unit upon being moved in a predetermined direction while being held at said knob part of said second fixing unit supporting member.

5. The image forming apparatus according to claim 4, wherein said fixing unit falling off preventing device further comprises a return device to return said second fixing unit supporting member to a position to support said fixing unit after releasing support of said fixing unit.

6. An image forming apparatus, comprising:

a fixing unit, detachably provided in said image forming apparatus, to fix a toner image transferred on a sheet onto the sheet; and a fixing unit falling off preventing device to prevent said fixing device from falling off of said image forming apparatus, said fixing unit falling off preventing device including a first fixing unit supporting member to support said fixing unit at a predetermined position within said image forming apparatus and to release support of said fixing unit upon being depressed, and a second fixing unit supporting member to restrict and release movement of said first fixing unit supporting member in a direction to release support of said fixing unit.

7. An image forming apparatus, comprising:

a fixing unit, detachably provided in said image forming apparatus, to fix a toner image transferred on a sheet onto the sheet; and fixing unit falling off preventing means for preventing said fixing unit from falling off of said image forming apparatus, said fixing unit falling off preventing means including first fixing unit supporting means and second fixing unit supporting means each for supporting said fixing unit at a predetermined position within said image forming apparatus, said first fixing unit supporting means releasing support of said fixing unit upon being depressed, and said second fixing unit supporting means releasing support of said fixing unit upon being rotated in a predetermined direction.

8. The image forming apparatus according to claim 7, further comprising:

a cover that opens and closes relative to said image forming apparatus to uncover and cover, respectively, said fixing unit; and said second fixing unit supporting means including means for obstructing said cover from moving to a position to be closed by abutting against said cover when said second fixing unit supporting means is not supporting said fixing unit.

9. The image forming apparatus according to claim 7, wherein said fixing unit falling off preventing means further comprises structure for returning said second fixing unit supporting means to a position to support said fixing unit after releasing support of said fixing unit.

10. An image forming apparatus, comprising:

a fixing unit, detachably provided in said image forming apparatus, to fix a toner image transferred on a sheet onto the sheet, said fixing unit including a case having a knob at a part thereof; and fixing unit falling off preventing means for preventing said fixing unit from falling off of said image forming apparatus, said fixing unit falling off preventing means including first fixing unit supporting means and second fixing unit supporting means each for supporting said fixing unit in a predetermined position of said image forming apparatus, said first fixing unit supporting means releasing support of said fixing unit upon being depressed, and said second fixing unit supporting means having a knob part opposing said knob of said case of said fixing unit in a vicinity of said fixing unit and releasing support of said fixing unit upon being moved in a predetermined direction, while being held at said knob part of said second fixing unit supporting means.

11. The image forming apparatus according to claim 10, wherein said fixing unit falling off preventing means further comprises return means for returning said second fixing unit supporting means to a position to support said fixing unit after releasing support of said fixing unit.

12. An image forming apparatus, comprising:

a fixing unit, detachably provided in said image forming apparatus, to fix a toner image transferred on a sheet onto the sheet; and fixing unit falling off preventing means for preventing said fixing unit from falling off of said image forming apparatus, said fixing unit falling off preventing means including first fixing unit supporting means for supporting said fixing unit in a predetermined position of said image forming apparatus, said first fixing unit supporting means releasing support of said fixing unit upon being depressed, and second fixing unit supporting means for restricting and releasing movement of said first fixing unit supporting means in a direction to release support of said fixing unit.

13. A device to prevent a fixing unit, detachably provided in an image forming apparatus, to fix a toner image transferred on a sheet onto the sheet, from falling off said image forming apparatus, said device comprising:

a first fixing unit supporting member that is configured to support said fixing unit at a predetermined position within said image forming apparatus and to release support of said fixing unit upon being depressed; and a second fixing unit supporting member that is configured to support said fixing unit at said predetermined position within said image forming apparatus and to release support of said fixing unit upon being rotated in a predetermined direction.

14. The device according to claim 13, wherein said second fixing unit supporting member includes a closure obstructing part that is configured to abut against a cover, that opens and closes relative to said image forming apparatus to uncover and cover, respectively, said fixing unit, when said second fixing unit supporting member is not supporting said fixing unit, so as to obstruct said cover from moving to a position to be closed.

15. The device according to claim 13, further comprising a return device for returning said second fixing unit supporting member to a position to support said fixing unit after releasing support of said fixing unit.

16. A device to prevent a fixing unit, which is detachably provided in an image forming apparatus and which fixes a toner image transferred on a sheet onto the sheet, from falling off said image forming apparatus, said device comprising:

a first fixing unit supporting member configured to support said fixing unit in a predetermined position of said image forming apparatus and to release support of said fixing unit upon being depressed; and a second fixing unit supporting member configured to have a knob part opposing a knob, said knob being provided at a part of a case of said fixing unit, in a vicinity of said fixing unit, and configured to support said fixing unit at said predetermined position within said image forming apparatus and to release support of said fixing unit by being moved in a predetermined direction, while being held at said knob part of said third fixing unit supporting member.

17. The device according to claim 16, further comprising a return device to return said second fixing unit supporting member to a position to support said fixing unit after releasing support of said fixing unit.

18. A device to prevent a fixing unit, detachably provided in an image forming apparatus to fix a toner image transferred on a sheet onto the sheet, from falling off said image forming apparatus, said device comprising:

a first fixing unit supporting member configured to support said fixing unit at a predetermined position within said apparatus and to release support of said fixing unit upon being depressed; and a second fixing unit supporting member configured so as to restrict and release movement of said first fixing unit supporting member in a direction to release support of said fixing unit.

19. A device to prevent a fixing unit, detachably provided in an image forming apparatus to fix a toner image transferred on a sheet onto the sheet, from falling off of said image forming apparatus, said device comprising:

first fixing unit supporting means for supporting said fixing unit at a predetermined position within said image forming apparatus, said first fixing unit supporting means releasing support of said fixing unit upon being depressed; and second fixing unit supporting means for supporting said fixing unit at said predetermined position within said apparatus, said second fixing unit supporting means releasing support of said fixing unit upon being rotated in a predetermined direction.

20. The device according to claim 19, wherein said second fixing unit supporting means including means for obstructing a cover that opens and closes relative to said image forming apparatus to uncover and cover, respectively, said fixing unit from moving to a position to be closed by abutting against said cover when said second fixing unit supporting means is not supporting said fixing unit.

21. The device according to claim 19, further comprising means for returning said second fixing unit supporting means to a position to support said fixing unit after releasing support of said fixing unit.

22. A device to prevent a fixing unit, detachably provided in an image forming apparatus to fix a toner image transferred on a sheet onto the sheet, from falling off said image forming apparatus, said device comprising:

first fixing unit supporting means for supporting said fixing unit at a predetermined position within said image forming apparatus, said first fixing unit supporting means releasing support of said fixing unit upon being depressed; and second fixing unit supporting means for supporting said fixing unit at said predetermined position of said image forming apparatus, said second fixing unit supporting means having a knob part opposing a knob, provided at a part of a case of said fixing unit, in a vicinity of said fixing unit, and releasing support of said fixing unit upon being moved in a predetermined direction, while being held at said knob part of said second fixing unit supporting means.

23. The device according to claim 22, further comprising means for returning said second fixing unit supporting means to a position to support said fixing unit after releasing support of said fixing unit.

24. A device to prevent a fixing unit, detachably provided in an image forming apparatus to fix a toner image transferred on a sheet onto the sheet, from falling off said image forming apparatus, said device comprising:

first fixing unit supporting means for supporting said fixing unit at a predetermined position of said image forming apparatus, said first fixing unit supporting means releasing support of said fixing unit upon being depressed; and second fixing unit supporting means for restricting and releasing movement of said first fixing unit supporting means in a direction to release support of said fixing unit.

25. A method of preventing a fixing unit, detachably provided in an image forming apparatus to fix a toner image transferred on a sheet onto the sheet, from falling off of said image forming apparatus, said method comprising the steps of:

depressing a first fixing unit supporting member supporting said fixing unit at a predetermined position within said apparatus to release support of said fixing unit; and rotating a second fixing unit supporting member supporting said fixing unit at said predetermined position within said image forming apparatus in a predetermined direction to release support of said fixing unit.

26. The method according to claim 25, further comprising the step of:

returning said second fixing unit supporting member to a position to support said fixing unit after support of said fixing unit by said second fixing unit supporting member is released.

27. A method of preventing a fixing unit, detachably provided in an image forming apparatus to fix a toner image transferred on a sheet onto the sheet, from falling off of said image forming apparatus, said method comprising the steps of:

depressing a first fixing unit supporting member supporting said fixing unit at a predetermined position of said image forming apparatus to release support of said fixing unit; and moving a second fixing unit supporting member supporting said fixing unit at said predetermined position within said image forming apparatus in a predetermined direction to release support of said fixing unit.

28. The method according to claim 27, further comprising the step of:

returning said second fixing unit supporting member to a position to support said fixing unit after support of said fixing unit by said third fixing unit supporting member is released.

29. A method of preventing a fixing unit, detachably provided in an image forming apparatus to fix a toner image transferred on a sheet onto the sheet, from failing off said image forming apparatus, said method comprising the steps of:

releasing a restriction on movement of a first fixing unit supporting member supporting said fixing unit at a predetermined position of said image forming apparatus in a direction to release support of said fixing unit; and depressing said first fixing unit supporting member to release support of said fixing unit.

* * * * *